US005535956A

United States Patent [19]

Irmen

[11] Patent Number: 5,535,956

[45] Date of Patent: Jul. 16, 1996

[54] PALLET WITH TEMPORARILY SEPARABLE ARBOR FOR INDIVIDUAL TRANSPORT OF TEXTILE BOBBINS AND TEXTILE TUBES

[75] Inventor: Wolfgang Irmen, Monchen-Gladbach, Germany

[73] Assignee: W. Schlafhorst AG & Co., Moenchen-Gladbach, Germany

[21] Appl. No.: 172,883

[22] Filed: Dec. 22, 1993

[30] Foreign Application Priority Data

Dec. 23, 1992 [DE] Germany ..... 42 43 775.5

[51] Int. Cl.[6] ..... B65H 54/00; B65H 49/02

[52] U.S. Cl. ..... 242/18 R; 57/266; 57/274; 57/281; 242/130.2; 242/571.5

[58] Field of Search ..... 242/18 R, 35.6 E, 242/35.5 A, 130.2, 571.5; 57/273, 274, 281, 90, 266

[56] References Cited

U.S. PATENT DOCUMENTS

| | | | |
|---|---|---|---|
| 4,848,077 | 7/1989 | Kawarabashi et al. | 242/35.6 E |
| 5,207,052 | 5/1993 | Fink et al. | 57/281 X |
| 5,255,776 | 10/1993 | Grecksch et al. | 242/35.5 AX |
| 5,297,671 | 3/1994 | Ruth | 242/35.5 A |

FOREIGN PATENT DOCUMENTS

| | | |
|---|---|---|
| 3308171A1 | 9/1983 | Germany . |
| 3416387A1 | 11/1984 | Germany . |
| 38433553A1 | 7/1990 | Germany . |
| 411655A1 | 11/1991 | Germany . |
| 4041715A1 | 6/1992 | Germany . |
| 4217330A1 | 12/1992 | Germany . |
| 4131527A1 | 3/1993 | Germany . |
| 52-25139 | 2/1977 | Japan . |

*Primary Examiner*—Daniel P. Stodola
*Assistant Examiner*—William Stryjewski
*Attorney, Agent, or Firm*—Shefte, Pinckney & Sawyer

[57] ABSTRACT

The handling of textile bobbins and textile bobbin tubes, particularly in yarn end preparation of textile bobbins, is improved by the pallet of the present invention which has an arbor of longer axial length than the textile bobbin tube it supports so as to protrude sufficiently from the textile bobbin tube that the arbor can be gripped while the textile bobbin remains supported on the pallet. A releasable connection between the base plate and arbor of the pallet in the preferred form of a functionally detachable plug-type snap connection allows for a temporary separation of these components. A pot-like covering body for the textile bobbin is connected to the base plate, particularly for conical or cylindrical cross-wound bobbins.

11 Claims, 2 Drawing Sheets

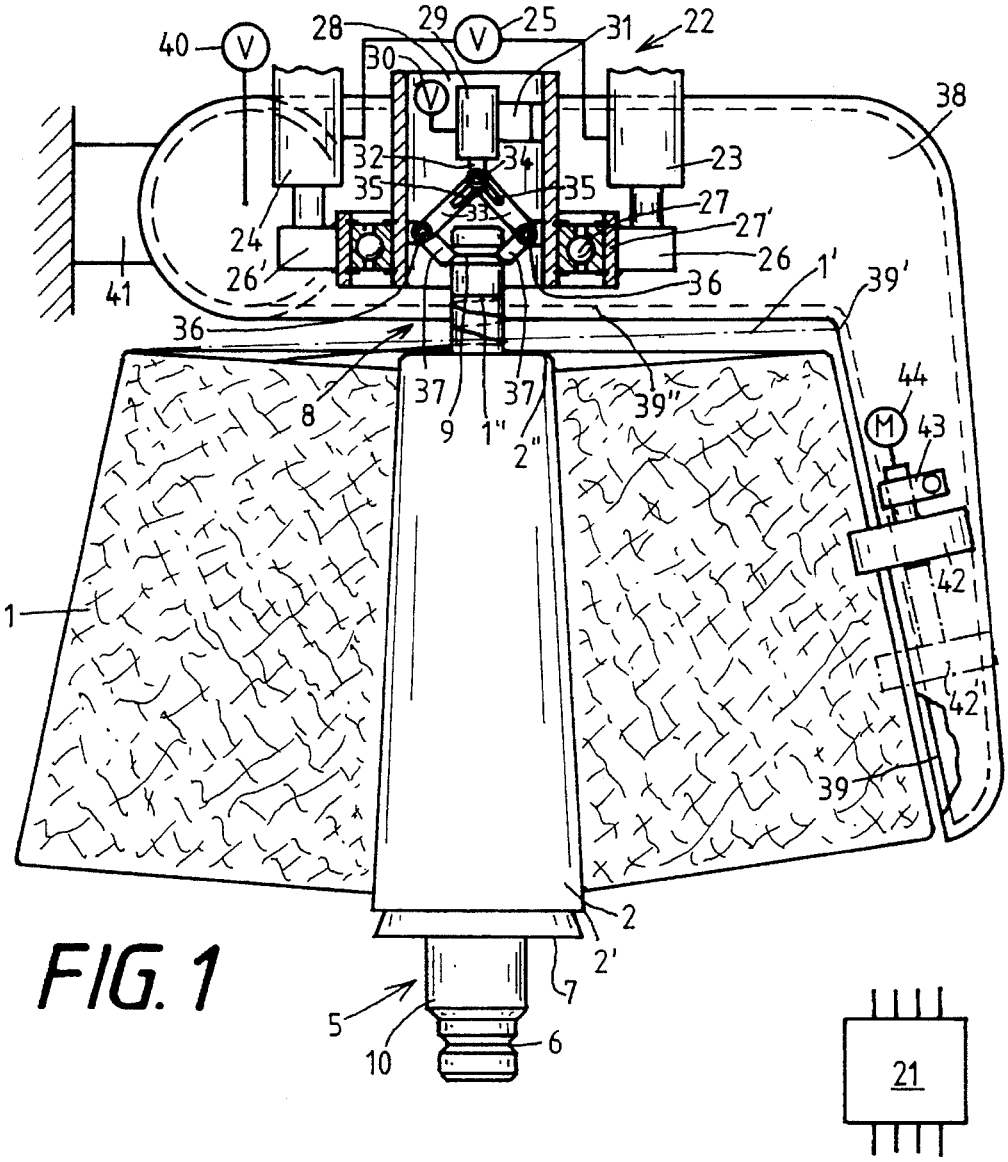
FIG. 1
FIG. 2
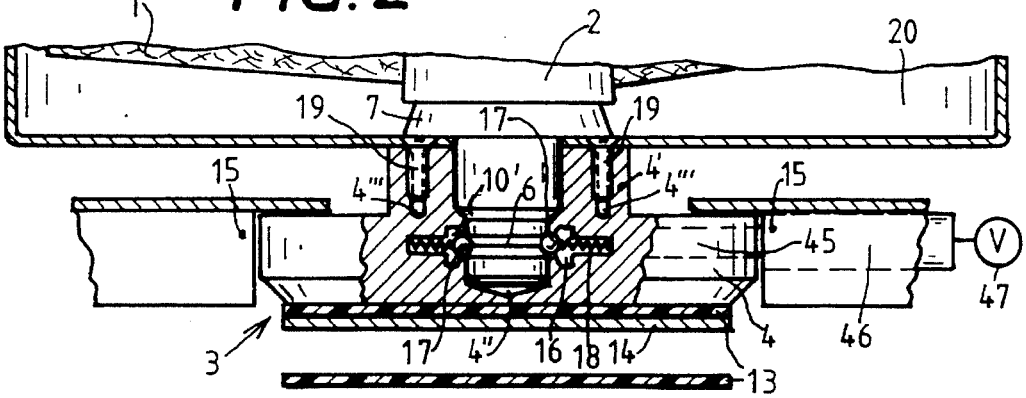

PALLET WITH TEMPORARILY SEPARABLE ARBOR FOR INDIVIDUAL TRANSPORT OF TEXTILE BOBBINS AND TEXTILE TUBES

FIELD OF THE INVENTION

The present invention relates to a pallet adapted for independent individual transport of textile yarn bobbins and tubes, particularly pallets of the type having a base plate and an upstanding arbor or pin for insertion into the bobbin or tube when placed on the base plate.

BACKGROUND OF THE INVENTION

Transport systems for textile yarn bobbins or cops in which pallets of the above type circulate on various segments of transport paths formed by rail-like transport channels for the base plates of the pallets have been known for a relatively long period of time, for example from Japanese Published, Non-Examined Patent Application JP-OS-52-25139. Pallets of this type for cylindrical or conical cross-wound bobbins are also known from German Patent Publication DE 34 16 387 A1, for example. In either case, it is common to prepare the cop or bobbin for subsequent yarn unwinding by locating and placing the leading end of the yarn at an accessible disposition on the cop or bobbin, e.g., by placement within the interior of the cop's tube or on the outer surface thereof.

To prepare cops with a yarn end preparation mechanism or machine, it is known from German Patent Publication DE 33 08 171 A1, for example, to remove the cops from their pallets to prepare the arbors and to transport the cops through the preparation device in this form. For this purpose each cop is gripped at the tip of its tube and, thus, the gripping device must conform to the tip of the tube. Moreover, the axial length of the tip of the tube unoccupied by yarn windings must be sufficient to enable gripping of the cop reliably without damaging the yarn windings thereon. In addition, when the leading end of the yarn is not to be positioned within the tube, but as an outer winding thereon, there must be sufficient space remaining beneath the gripping element on the tip of the tube.

For relatively large textile bobbins, such as conical or cylindrical cross-wound bobbins that have a correspondingly high weight, it is very difficult to generate a sufficiently strong clamping force on the tip of the tube without causing damage to the tube.

German Patent Application P 41 31 527.8 (which is not a prior art publication) discloses a pallet whose arbor and base plate respectively are produced from separate components that can be connected to one another by means of a lockable connection used for the purpose of selectively connecting any one of several different arbors to a uniform base plate construction when cops with varying inside tube diameters are to be prepared during a batch change. Accordingly, the lockable connection is designed such that the pallets whose arbors are to be changed can have the old arbor released by an auxiliary device and provided with a new arbor.

SUMMARY OF THE INVENTION

It is an object of the present invention to provide an improved pallet that permits advantageous handling of the textile bobbins in different processing stations, particularly in preparation stations for textile bobbins of various sizes, by means of temporary separations of the arbor from the base plate of the pallet.

Briefly summarized, this object is attained in accordance with the present invention by means of a pallet having an arbor which is separable from the base plate of the pallet and which is also longer in axial dimension than the textile bobbin it supports so as to protrude sufficiently beyond the tip of the bobbin tube to be grasped by a gripping means in the assembled condition of the pallet. The connection between the base plate and the arbor should be a detachable plug-type connection enabling temporary separation and reassembly of the base plate and arbor.

Particularly in preparation devices in which the beginning of the yarn of the textile bobbin is searched for and repositioned at a suitable point from which the yarn end can later be regripped at a winding station, it is necessary for the bobbin to be accessible at every position for searching for the leading end of the yarn. Furthermore, it is advantageous that the bobbin and yarn-searching element be positioned as closely to each other as possible. In this case, the considerable differences in various wound diameters and configurations between various conical and cylindrical cross-wound bobbins, for example, must also be taken into consideration.

All of these considerations and objectives can be accommodated by the pallet of the present invention in that the textile bobbin can be removed from the pallet's base plate and in turn from the pallet transport system by a gripping means pulling the arbor with the bobbin from the base plate. The textile bobbin can then be positioned, with the aid of the gripping means, at an arbitrary point and thus also in the optimum position with respect to the yarn-gripping means. In this instance, the textile bobbin tube is not touched at all by the gripping means. Therefore the gripping means also need not be adapted in its configuration, size or otherwise to the textile bobbin tube. There is no requirement of a specific length of the tip of the tube for reliable gripping of the textile bobbin. By the gripping means, the extended arbor of the present pallet can receive the leading end of the yarn beneath the gripping location in a plurality of yarn windings if the yarn end has not been positioned on the tip of the tube or inside the tube. Moreover, it is also possible to further transport the separated base plate on its transport path, and load a new textile bobbin thereon with another arbor, which presents the option of increasing flexibility in the transport system.

The invention offers the advantageous possibility of fixedly disposing a pot-like covering body on the base plate that, when used particularly with conical and cylindrical cross-wound bobbins, protects the base plate outwardly and, during yarn unwinding, can simultaneously function as a balloon delimiter. In contrast to a divided collar, disclosed for example from German Patent Disclosure DE 38 433 553 A1, this pot-like covering body has the advantage that it need not be pivoted in the unwinding position for the entrance and exit of the cross-wound bobbins which, given the size of the bobbins, would cause considerable problems with respect to the distribution of the bobbin position.

The plug connection between the arbor and the base plate is preferably a resilient snap-type connection engageable and disengageable by applying an axial force to the arbor and base plate, which permits frequent release and re-establishment of the connection on a substantially arbitrary basis. In this case there are no axial forces that must be overcome. Therefore, the connection is highly dependable both for transport of the pallets and also in the processing stations.

Because the textile bobbin must also be supported reliably after the arbor has been released from the base plate, appropriate means are provided for securing the bobbin position, preferably in the form of a conical base portion on the arbor for supporting a lower end of the textile bobbin tube. By virtue of its conical shape, the base portion of the arbor serves to center the textile bobbin tube on the arbor. Resilient elements that are radially inwardly elastic prevent the bobbin from twisting on the arbor. However, the biasing forces of these flexible elements should not be so great that the force necessary to remove the bobbin or its tube from the arbor simultaneously separates the arbor from the base plate. Optionally, the arbor could be supported from above to prevent separation from the base plate when the bobbin or tube is pulled off, or alternatively the arbor could be intentionally separated from the base plate for pulling off the tube or bobbin.

It is also preferred that the arbor have a groove at its upper end so that the gripping means can grip the arbor in a reliable form-fitting manner, whereby the demands on the clamping capability of the gripping means may be decreased.

BRIEF DESCRIPTION OF THE DRAWINGS

FIG. 1 is a side elevational view of an arbor of a pallet according to the present invention, shown carrying a textile bobbin and separated from the base plate of the pallet by a gripping means of a yarn end preparation device;

FIG. 2 is a detailed view of the pallet of the present invention, partially in side elevation and partially in axial cross-section, shown traveling in a transport track with an arbor inserted into the base plate.

DESCRIPTION OF THE PREFERRED EMBODIMENT

Figure 3:
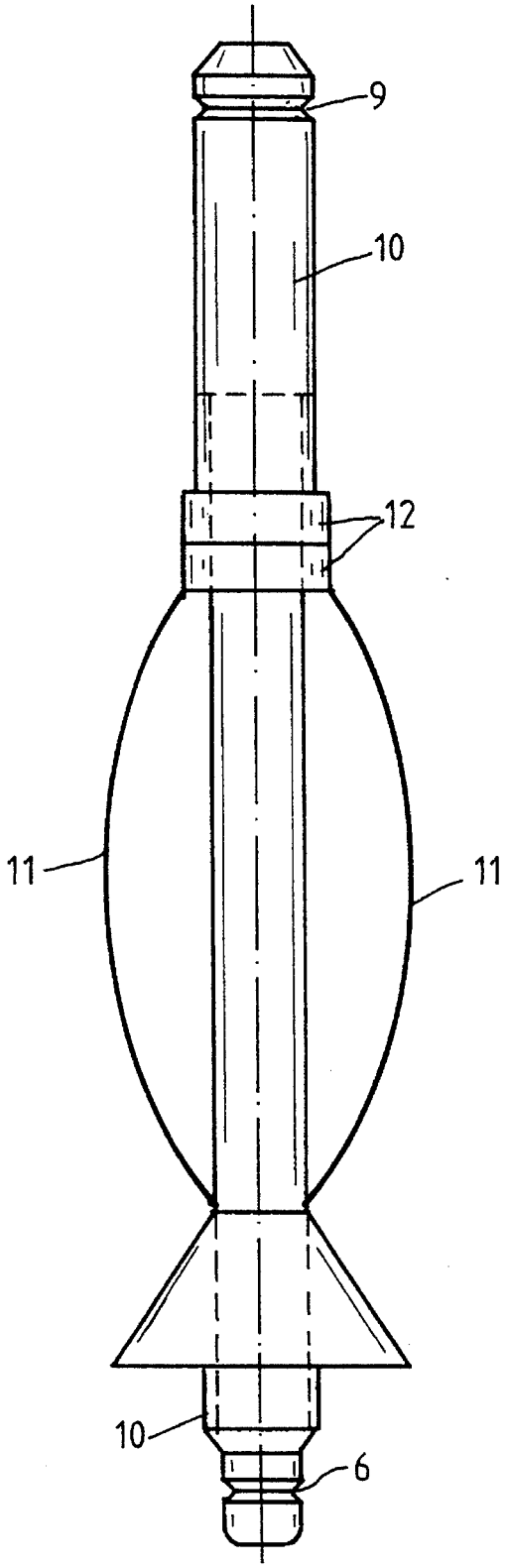
FIG. 3 is a side elevation of a separated arbor of the pallet in accordance with the present invention.

In the accompanying drawings, the pallet of the present invention is shown as supporting a textile bobbin in the form of a conical cross-wound bobbin 1 having a body of yarn wound on a textile bobbin tube 2, which is supported on an arbor of the pallet. Those persons skilled in the art will of course recognize, however, that the present pallet is equally susceptible of use with other forms of bobbins.

Referring initially to FIG. 2, a preferred embodiment of the pallet of the present invention is shown generally at 3, partially sectioned in order to illustrated the connection of its base plate 4 with its arbor 5. For this purpose, the base plate 4 has a central, axial bore 4" that extends through a platform 4' of the base plate 4, almost to the bottom surface of the base plate 4. The bore 4" in turn has radial bores 16, into which compression springs 18 and balls 17 are inserted. The radial bores 16 are enlarged in the shape of a dome adjacent their ends facing the central longitudinal axis of the pallet 3 to enable receipt of the balls 17. However, the openings of these bores 16 into the bore 4" have a diameter that is, of course, smaller than the diameter of the balls to prevent the balls from falling out. The radial bores 16 with the balls 17 and the compression springs 18 are present in four sets in the illustrated embodiment and are distributed at equal intervals about the circumference of the bore 4". In this embodiment, the balls 17 engage in an annular groove 6 of the arbor 5, by which the arbor is held securely. Further details of the description of this resilient snap-type connection are omitted because snap connections of the described type are generally known.

As can further be seen from FIG. 2, the arbor 5 rests with its lower end edge against the lower end of the bore 4" and a chamfer of the shank 10 of the arbor 5 rests on an outwardly tapering region of the bore 4". The arbor 5 further includes a base 7 affixed to the shank 10 above the tapered region, which base 7 rests on a portion of the bottom surface of a pot-shaped covering body 20 secured to the platform surface 4' of the base plate 4. By means of this collective arrangement of components of the arbor 5, the weight of the conical cross-wound bobbin 1 can be reliably received and supported by the pallet 3.

At least two vertical internally-threaded bores 4" are formed in the platform 4' of the base plate 4 and fastening screws 19 for the pot-like covering body 20 are engaged threadedly into these bores 4". In this manner, the pot-like covering body 20 is connected securely to the base plate 4. In the illustration of FIG. 1, the conical cross-wound bobbin together with the arbor 5 is shown as lifted out of this pot-like covering body 20, whereby the conical cross-wound bobbin 1 is accessible from all sides for mechanical or manual searching for the leading end of the yarn thereon.

A typical transport system for the pallets 3 is also indicated in FIG. 2. This system essentially comprises a conveyor belt 13 that is supported along its pallet-carrying run by a sheet metal support plate 14. The transport path of the pallets 3 is defined laterally by guide profiles 15. A stop element 45, which is displaceable into and out of the transport path by a horizontally disposed fluid cylinder 46, is disposed downstream and can stop each respective pallet 3 by engaging its base plate 4 on the continuously moving conveyor belt 13. In such stopped position, the arbor 5 can be lifted from the base plate 4 onto which the pot-like covering body 20 is screwed.

The fluid cylinder 46 for the stop element 45 is connected to a compressed air source (not shown) via a valve 47 which can be operated by a control unit 21 to be able to accurately control the stopping and release of the arriving pallets 3.

FIG. 1 illustrates a lifting mechanism 22 which is preferably disposed above the stop position and is equipped with gripping means in the form of claw arms 37 which engage in a groove 9 on the upper end portion 8 of the arbor 5 protruding beyond the upper tip end of the bobbin tube 2. This conforming fit of the gripping means with the arbor 5 permits a reliable gripping of the arbor 5.

The lifting mechanism 22 has two fluid cylinders 23,24, to whose pistons respective supports 26,26' are secured. These supports 26,26' are in turn connected to an outside race 27' of a ball bearing assembly 27. The inside race of the ball bearing assembly 27 is formed by a tubular element 28, in which are secured a fluid cylinder 29 supported by a holding device 31 and holding devices for pivot shafts 36 of the claw arms 37. An actuating pin 34 extends through longitudinal holes 35 in cross arms 33 of the gripping means and is affixed to a piston 32 of the fluid cylinder 29. The cross arms 33 are attached, together with claw arms 37, to the pivot shafts 36.

The fluid cylinder 29 can be temporarily connected via a valve 30 to a compressed air source (not shown). The valve 30 can also be activated by the control unit 21.

The two fluid cylinders 23 and 24 can likewise be temporarily connected to the compressed air source by a common valve 25. An angular aspiration tube 38 is disposed adjacent to the lifting mechanism and has an aspiration slit 39 oriented to the conical cross-wound bobbin when it is stopped and lifted into the position shown in FIG. 1. The aspiration tube 38 is connected to the base of the associated textile machine via a mounting bracket 41. The aspiration tube 38 is connected via a valve 40 to an aspiration air source (also not shown).

A friction driving wheel 42 and a drive motor 44 for driving rotation of the wheel 42 are mounted on the aspiration tube 38 by means of a bracket 43.

After a pallet 3 with a conical cross-wound bobbin 1 has arrived under the lifting mechanism 22, the base plate 4 is stopped on the conveyor belt 13 by means of actuating the stop element 45. The arrival of the pallet 3 is signalled to the control unit 21 by means of an appropriate sensor (not shown). The control unit 21 first actuates the two fluid cylinders 23,24 via their valve 25, which lowers the tubular element 28 to position the claw arms 37 at the height of the groove 9 of the arbor 5. At the same time, the piston 32 is also extended by means of a compression spring within the cylinder 29, whereby the claw arms 37 are spread open.

After the described disposition for the tubular element 28 has been reached, the controller 21 actuates delivery of compressed air into the lower part of the fluid cylinder 29 via the valve 30, by means of which the piston 32 is withdrawn counter to the force of the compression spring, whereby the aforedescribed connection of the piston to the cross arms 33 and, via the shafts 36, with the claw arms 37 causes the claw arms to move toward one another and enter into the groove 9, into which they are pressed by means of the air pressure present in the fluid cylinder 29.

After a predetermined period of time, the fluid cylinders 23,24 are again triggered via the valve 25 to lift the tubular element 28 via the support 26 until it reaches the elevated position shown in FIG. 1. After this position has been reached, the motor 44 is activated by the control unit 21, causing the driving wheel 42 to rotate and to drive the conical cross-wound bobbin 1 by frictional engagement with its circumference. The search for the free leading end of the wound yarn is executed during this period of time. For this purpose the valve 40 is opened to connect the aspiration tube 38 to a suction air source.

As soon as the end of the yarn passes the aspiration slit 39 during rotation of the conical cross-wound bobbin 1, the end is entrained by the aspiration flow and sucked into the aspiration tube 38. A sensor (not shown) identifies the arrival of the leading end of the yarn and transmits a corresponding signal to the control unit 21. The control unit then immediately stops the motor 44 so that no additional length of yarn is sucked into the aspiration tube 38.

In this case, the yarn is diverted at the upper end of the aspiration slit 39. Advantageously, the end of the yarn is then shortened to a predetermined length by means of a separating, cutting or other suitable device (not shown) in the aspiration tube 38. Thereafter, the motor 44 is triggered again by the control unit 21 to drive the driving wheel 42 in the opposite direction from that previously carried out. After approximately a half-rotation of the conical cross-wound bobbin 1, the yarn 1', shown in dashed lines in FIG. 1, then extends from the outer edge of the conical cross-wound bobbin to the upper edge 39' of the aspiration slit 39 in the form of a chord relative to the bobbin diameter. As the conical cross-wound bobbin 1 is rotated further, the chord travels toward the exposed upper end portion 8 of the arbor 5 protruding out of the bobbin tube 2 and is wound on in several windings 1" as the conical cross-wound bobbin 1 rotates further, as can be seen in FIG. 1.

After a predetermined number of rotations of the conical cross-wound bobbin 1, the motor 44 is stopped by the control unit 21 to complete the positioning of the yarn windings on the arbor 5, at which point the shortened yarn end has exited the aspiration tube 38.

The end of the aspiration slit 39 is shown as a variant in a position 39" in FIG. 1, which achieves a clearly shortened distance from the exposed portion 8 of the arbor 5 protruding from the tube 2. In this manner, the length of the yarn end, which is released after being wound onto the arbor portion 8, is kept considerably shorter. Yarn guiding means (not shown) that accomplish an exact positioning of the yarn end windings on the arbor 5 are also conceivable. For example, a lever may be attached to the outer ball bearing race 27' to extend to the protruding portion 8 of the arbor 5.

It is also conceivable to place the yarn windings of the leading end of the yarn onto the tip 2' of the bobbin tube 2 itself when the tube tip 2' protrudes sufficiently beyond the yarn windings of the cross-wound bobbin 1.

After such yarn end preparation of the conical cross-wound bobbin 1 has been completed, the two fluid cylinders 23,24 are deventilated via the valve 25, so that the tubular element 28 lowers again due to the textile bobbin's own weight. The weight of the cross-wound bobbin 1 is also normally sufficient to overcome the resistance of the compression springs 18 so as to re-establish the snap connection of the arbor 5 to the base plate 4. However, to ensure that the snap connection locks completely, the option exists of connecting the fluid cylinders 23,24 to the compression air source by their other end via another valve (not shown) to increase the lowering force, at least during the end of the lowering phase, to insure a reliable locking engagement of the snap connection.

After the tubular element 28 has reached its end position, the valve 30 is triggered via the control unit 21 to vent the fluid cylinder 29 so that the piston 32 is extended. Thus, the claw arms 36 reopen and release the arbor 5. Subsequently, the valve 47 can be triggered to retract the stop element 45 into the fluid cylinder 46 and release the pallet 3 for further transport by means of the conveyor belt 13.

FIG. 3 illustrates the entirety of the arbor 5 separated from the base plate 4 and without any supported bobbin thereabout. In addition to the conical base 7, on which the tube 2 is supported by its tube foot 2' and simultaneously centered, spring wires 11 extend lengthwise along the shank 10 of the arbor 5 to act as radially inwardly flexible, elastic elements to provide additional guidance for the tube 2 of the conical cross-wound bobbin 1. Check nuts 12 threadedly screwed onto the shank 10 of the arbor 5 serve to adjust the flexing of the spring wires 11 which can thus be bowed outwardly to varying degrees to be adaptable to varying tube inside diameters.

If the conical cross-wound bobbin 1 is prepared in the described manner for subsequent yarn unwinding, it is possible to re-expose the leading end of the yarn within the winding station in which the conical cross-wound bobbin 1 is subsequently to be unwound, and to deliver the yarn end to an appropriate gripping element of a yarn-connecting device, e.g., a splicer, even if the arbor 5 remains on the base plate 4 and the conical cross-wound bobbin 1 is enclosed by the pot-like cover 20. This is possible when a compressed air nozzle arrangement mounted to a repositionable support is disposed with respect to a bobbin supplied to the unwinding station in the region of the windings of the leading end of the yarn. If this nozzle arrangement encloses the protruding portion 8 of the arbor 5, it is also unnecessary, in contrast with known devices, to dispose a nozzle beneath the unwinding station to blow out a yarn end positioned in the tube through a hollow arbor and the tube itself.

The lifting mechanism 22 can additionally be connected to a displacement or pivoting device (not shown) that operates to position the textile bobbin in contact with the driving roller 42 so that the same spacing is always maintained between the upper yarn winding surface of the bobbin and the aspiration slit 39, regardless of the amount of yarn on the bobbin. To simultaneously take into consideration possible differences in the conical shape of conical cross-wound bobbins 1 as a result of differing amounts of yarn on the bobbins, it is also possible to provide a second drive roller 42', shown in dashed lines in FIG. 1, on the same drive shaft as the drive roller 42. This arrangement ensures that the yarn winding surface of the bobbin is always disposed parallel to the aspiration slit 39. A slight tilting of the conical cross-wound bobbin 1 itself can be compensated by a pivotability of the aspiration nozzle 38, for example.

Unlike the illustrated representation, it is therefore also possible in principle to pivot the arbor 5 or the lifting mechanism 22 out of the longitudinal axis of the pallet 3 for yarn end preparation operations when the aspiration tube 38 is correspondingly offset to the side. The pivoting of the arbor 5 would then always be executed to a sufficient degree to bring the bobbin surface into contact with the drive roller 42 or the two drive rollers 42 and 42'.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A pallet for the independent, individual transport of yarn-wound and empty textile bobbin tubes in a transport system of a textile machine comprising a base plate for resting disposition on a moving transport means of the machine and an arbor upstanding from the base plate for positioning a textile bobbin tube thereon, the arbor and base plate being separate connectible and disconnectible components, the arbor being of a sufficiently greater length than the textile bobbin tube to protrude sufficiently from the textile bobbin tube to be grippable by a gripping means in the connected condition of the arbor and base plate, the arbor and base plate comprising a functionally detachable plug-type connection means wherein the arbor plugs into the base for the temporary separation of the arbor and base plate.

2. The pallet as defined by claim 1, and further comprising a covering body connected to the base plate for enclosing at least partially the yarn windings on a textile bobbin tube supported thereon.

3. The pallet as defined by claim 2, wherein the plug connection means comprises resilient snap means that is selectively disengageable and re-engageable by applying axial forces to the base plate and the arbor.

4. The pallet as defined by claim 1, wherein the arbor has means for fixing the position of the textile bobbin tube on the arbor.

5. The pallet as defined by claim 1, wherein the arbor has a base portion for supporting a lower end of the textile bobbin tube.

6. The pallet as defined by claim 5, wherein the base portion of the arbor is of a conical shape.

7. The pallet as defined by claim 1, wherein the arbor comprises resilient radially movable elements.

8. The pallet as defined by claim 1, wherein the arbor has at least one groove on the portion thereof which protrudes from the textile bobbin tube for reliable gripping by the gripping means.

9. A method of handling yarn-wound and empty textile bobbin tube during transport thereof in a transport system of a textile machine, the method comprising the steps of:

(a) providing for each textile bobbin tube a transport pallet having a base plate for resting disposition on a moving transport means of the textile machine and an arbor upstanding from the base plate for positioning the textile bobbin tube thereon, the arbor and the base plate comprising a functionally detachable plug-type connection means wherein the arbor plugs into the base plate for the temporary separation of the arbor and base plate;

(b) mounting each textile bobbin tube on the arbor of a respective one of the pallets;

(c) transporting the pallets on the transport means of the textile machine; and (d) temporarily disconnecting each textile bobbin tube and the arbor of its respective pallet from the base plate of the respective pallet, performing an operation with respect to the textile bobbin tube while the arbor and base plate are separated, and then re-connecting the arbor and its textile bobbin tube to the base plate.

10. The method of claim 9, wherein the step of performing an operation with respect to the textile bobbin tube comprises locating a leading end of yarn wound on the tube and placing the yarn end in a predetermined location for grasping in a subsequent unwinding operation.

11. The method of claim 9, wherein the step of temporarily disconnecting each bobbin tube and the arbor of its respective pallet from the base plate of the respective pallet comprises holding the base plate while pulling the arbor with sufficient force to release from the base plate.

* * * * *